US005429574A

United States Patent [19]

Murakami

[11] Patent Number: 5,429,574

[45] Date of Patent: Jul. 4, 1995

[54] SHAFT MEMBER FOR BUSINESS MACHINES AND THE LIKE AND ITS MANUFACTURING METHOD

[76] Inventor: Yukiyoshi Murakami, 11-16, Minamiurawa 3-chome, Urawa, Saitama, 336, Japan

[21] Appl. No.: 76,932

[22] Filed: Jun. 16, 1993

Related U.S. Application Data

[63] Continuation of Ser. No. 863,126, Apr. 3, 1992, abandoned.

[30] Foreign Application Priority Data

Apr. 9, 1991 [JP] Japan ..... 3-103868

[51] Int. Cl.[6] ..... B65H 3/06

[52] U.S. Cl. ..... 492/39; 138/177; 193/37; 271/109; 285/382; 403/282; 403/383; 492/60

[58] Field of Search ..... 492/42, 39, 45, 60; 29/525, 451, 515, 516; 72/367; 403/282, 274, 383, 192, 193, 194, 408.1, 202, 203, 204, 220, 221, 357, 372, 404; 193/37; 411/516, 530, 514, 75; 285/330, 382; 138/177, DIG. 5, DIG. 8, DIG. 11; 271/109, 113

[56] References Cited

U.S. PATENT DOCUMENTS

| | | | |
|---|---|---|---|
| 638,554 | 12/1899 | Burton | 29/516 |
| 2,080,361 | 5/1937 | Lindstrom | 403/383 X |
| 2,226,777 | 12/1940 | Martin | 492/45 X |
| 2,231,738 | 2/1941 | Shoup | 492/45 |
| 2,243,427 | 5/1941 | Kleffel | 492/45 X |
| 2,344,413 | 3/1944 | Richards | 29/525 X |
| 2,527,227 | 10/1950 | Namet | 285/382 X |
| 2,632,234 | 3/1953 | Fitz | 492/45 X |
| 2,783,069 | 2/1957 | Wightman | 403/357 X |
| 2,864,967 | 12/1958 | Redick et al. | 29/525 |
| 2,968,504 | 1/1961 | Hansen | 403/357 |
| 3,700,271 | 10/1972 | Blaurock et al. | 403/372 |
| 3,994,608 | 11/1976 | Swiderski et al. | 403/372 |
| 4,318,306 | 3/1982 | Fischer | 403/372 X |
| 4,445,257 | 5/1984 | Delhaes | 403/221 X |
| 4,612,695 | 9/1986 | Umeha et al. | 72/367 X |
| 4,763,503 | 8/1988 | Hughes et al. | 72/367 X |
| 4,910,857 | 3/1990 | Tanaka | 29/515 X |
| 4,974,680 | 12/1990 | Nishida et al. | 271/109 X |
| 5,104,026 | 4/1992 | Sturrus et al. | 72/367 X |
| 5,137,142 | 8/1992 | Reeves | 193/37 X |

*Primary Examiner*—Joseph M. Gorski
*Attorney, Agent, or Firm*—Townsend & Banta

[57] ABSTRACT

A hollow shaft tube and shaft member with functional members like a paper feed roller for business machines etc., and its manufacturing method.

The shaft tube has a bulge and dent, thereon a functional member to be fixedly secured. The bulges and dents having spring effect are formed symmetrically concerning the shaft tube center axis. The shaft and the functional members are fixedly secured by the spring effect.

The shaft tube is made with half molds, having punchs in holes of both halves. The punchs hit the tube set in the molds to form the bulge and dent. The shaft tube is pressed in the functional member, using a press-in tool, to construct the shaft member.

6 Claims, 2 Drawing Sheets

SHAFT MEMBER FOR BUSINESS MACHINES AND THE LIKE AND ITS MANUFACTURING METHOD

CROSS REFERENCE TO A RELATED APPLICATION

This is a file wrapper continuation application of application Ser. No. 07/863,126 filed Apr. 3, 1992, now abandoned.

BACKGROUND OF THE INVENTION

1. Field of the invention

The present invention disclosed broadly relates to a shaft tube on which a functional member is to be mounted and a hollow shaft member which comprises the shaft tube and the functional member, and manufacturing methods of the shaft tube and the shaft member. More particularly, the present invention relates to a shaft tube and a hollow shaft member suitable for a paper feed roller or the like mainly used for business machines such as a copying machine, word processor, facsimile etc., and also relates to manufacturing methods of the shaft tube and the hollow shaft member for that purpose.

2. Description of the Prior Art

Many shaft members are used for a paper feeder, copyholder, platen etc. in business machines such as a copying machine, word processor, facsimile etc. The shaft members are usually of solid steel. The solid material is heavy and expensive. The inventor of the present invention proposed a means with a hollow shaft tube or what is called just a shaft tube which the inner material was removed from, for the purpose of cutting the weight and the cost by saving the material, in Japanese Patent Application No. 291775/86.

When a functional member such as a paper feed roller is tried to be fixedly secured on the shaft tube, conventionally one of the following means or the like was obliged to be adopted, that is, a) to secure by using adhesive or by setting a screw or pin into an hole opened at a part of the functional member, b) to secure by pressing the functional member onto the knurled shaft tube, or c) to secure by injecting a material to mold the functional member incorporated with the shaft.

However, those means brought about a problem such as a) to be easy for the adhesion to weaken as time elapses, b) to be likely for the shaft tube to collapse due to high pressure for forming knurl on the shaft tube, or c) a fear for the shaft tube also to collapse due to high pressure and a complicated process to be needed in injection molding.

The approaches using the conventional arts with a shaft tube as above introduce a problem such as defects in workability or function, and anyway could not be satisfactory securing means.

OBJECTS OF THE INVENTION

It is therefore an object of the present invention, to provide a shaft tube whereon a functional member such as a paper feed roller typically molded of plastic is to be fixedly secured, a hollow shaft member comprising the shaft tube and the functional member and methods manufacturing the shaft tube and the shaft member, to eliminate the above mentioned drawbacks.

SUMMARY OF THE INVENTION

To attain the above-described object, the present invention provides a shaft tube comprising, a bulge swelled outer than a basic diameter of the shaft tube, and a dent adjacent to the bulge in a cross sectional view. The dent is sunk inside of the shaft tube, and has spring effect within a non-yielding scope. And the bulge and the dent are located at a position along the shaft tube where a functional member to be fixedly secured.

According to another aspect of the present invention, a plurality of sets of bulge and dent in the shaft tube are formed symmetrically with respect to a center axis of the shaft tube.

The present invention also provides a shaft member comprising, a shaft tube as described above and a functional member. The functional member is fixedly secured on the shaft tube at the location of the bulge and dent along the shaft tube.

The present invention also provides a manufacturing method of the shaft tube. It comprises the steps of cutting a tube in a predetermined length, and swelling the tube to form the bulge by placing the tube in a mold having a swelled contour to accommodate the bulge. The mold also has a holding contour of a basic diameter of the tube, and also has a punch through a hole accommodating the punch. The manufacturing method also comprises the step of hitting the tube using the punch to form the dent having spring effect within a non-yielding scope.

According to another aspect of the present invention, a manufacturing method of the shaft tube comprises the steps of cutting a tube in a predetermined length, and swelling the tube to form the bulges by placing the tube in a mold having swelled contours to accommodate the bulges. The mold also has a holding contour of a basic diameter of the tube, and the mold also has punchs through holes accommodating the punchs. And the manufacturing method also comprises the step of hitting the tube simultaneously using the punchs to form the dents having spring effect within a non-yielding scope.

The present invention also provides a fabrication method of the shaft member comprising the steps of placing the functional member in an annular groove of a press-in tool being provided with a hole therethrough the shaft tube to pass, the hole crossing the annular groove, and pressing the shaft tube into the hole so that the functional member is fixedly secured on the shaft tube.

Where the functional member such as a paper feed roller used for a copying machine, word processor etc. is driven by the shaft tube, a torque is exerted between the functional member and the shaft tube. According to the present invention, the shaft tube does not idle away from the functional member because of the following reasons. That is to say, in process of the shaft tube being thrusted into the functional member, the bulge is pressed by the bore or inner wall of the functional member and the pressing force makes the dent bent. The bending is in a predetermined extent calculated beforehand or within a non-yielding scope and keeps the dent elastic, which causes a kind of spring force. The spring force caused in the tube operates to make a strong pressing contact between the functional member and the shaft tube, which enables the shaft tube to rotate firmly without idling away the functional member. When the bulges are formed symmetrically with respect to the center axis of the tube, restoring forces by the spring effects acting to the bulges work in a reverse direction each other and generate strong forces for the bulges to be pressed to the inner wall of the functional member. Consequently, pressing forces directed to reverse directions cause the shaft tube to be fixedly secured to the functional member.

During the manufacturing process, the bulge and the dent of the shaft tube are formed in one stroke, in use of the mold and in the hitting process with the punchs.

In use of the split type press-in tool, the only series of press-in work, where the shaft tube is intruded laterally through the hole disposed in the split molds, can fixedly secure the functional members on the shaft tube to easily form the hollow shaft tube member.

Where the bulges and dents are located symmetrically with respect to the center axis of the tube, the shaft tube can be kept straight during the bulges and dents being formed and the shaft being pressed in the functional member, because the possible deflections of the shaft during the process to the reverse direction compensate each other. The symmetrical existence of the bulges and dents also gives a firm securing forces.

BRIEF DESCRIPTION OF THE DRAWINGS

These and other objects, features and advantages of the present invention will be more fully appreciated with reference to the accompanying figures.

FIG. 2 illustrates a partial cross section drawing of the mold to be used for the manufacturing method of the present invention.

DETAILED DESCRIPTION OF THE PREFERRED EMBODIMENT

Figure 1A:
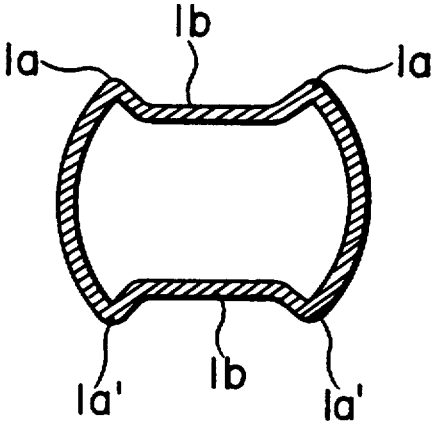
FIG. 1 illustrates a cross section of the shaft tube of the present invention in (A), and a cross section of the shaft tube of the present invention when the shaft tube is pressed in the functional
Figure 1B:
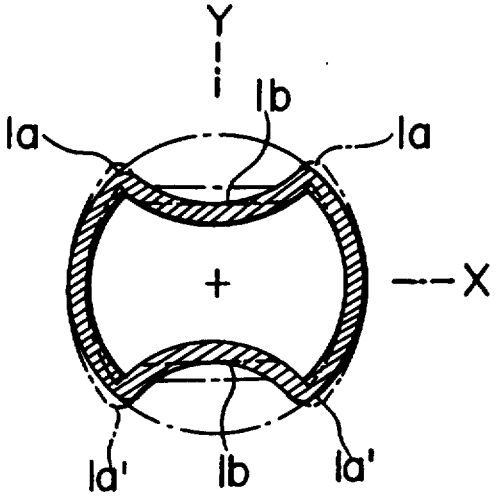
Figure 3:
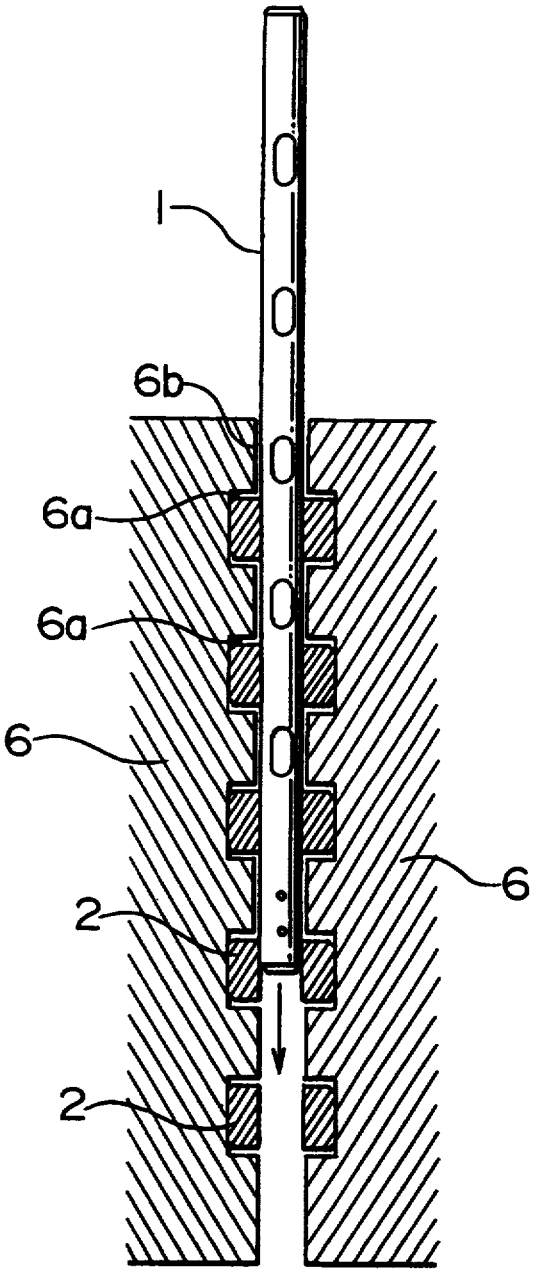
FIG. 3 illustrates a partial cross section of the press-in tool to be used for the manufacturing method of the present invention.
Figure 4:
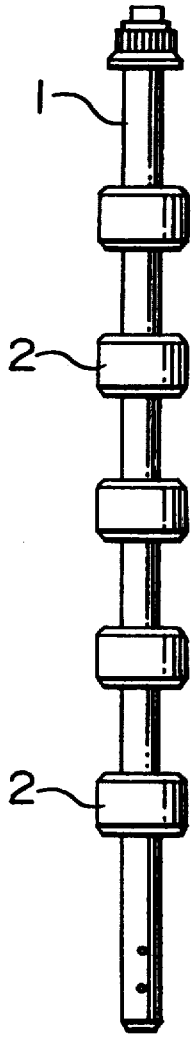
FIG. 4 illustrates a shaft member of the present invention.

Reference is first made to FIG. 1, wherein cross sections of a shaft tube according to the present invention are shown. A shaft tube designated as 1 in FIG. 3 and FIG. 4, is widely used as a part of a paper feeder or platen for business machines such as a copying machine, word processor or facsimile. The shaft tube is sometimes furnished with bearings for rotatable support or gears for driving at its ends depending on the purpose. The present invention, however, does not directly relate to the end features, but is only directed to the shaft part between the ends. A functional member such as a paper feed roller designated as 2 in FIG. 3 and FIG. 4, is sometimes made of elastic material such as gum, but is typically made of plastic or metal in the present invention.

In the embodiment, the present invention is constructed by forming a bulge 1*a* swelled outer than a basic diameter of the shaft tube which is hollow and a dent 1*b* sunk inside having spring effect within a non-yielding scope at a location for mounting the functional member on the shaft tube. The dent 1*b* is continuously adjacent to the bulge 1*a*. The construction is as follows. When the shaft tube is of round tube in a sectional shape as shown in FIG. 1, a bulge 1*a* is swelled a little outer than the contour circle to a curved shape at a location about 45 degree apart from XY axes, an adjacent part is straightened in parallel with X axis, an identical bulge and straightened part are formed symmetrically with respect to X axis, and in the same way bulges and straightened parts or dents are formed symmetrically with respect to Y axis. That is, bulges 1*a*,1*a* and 1*a*',1*a*' are formed symmetrically with respect to the center axis of the shaft tube, and the dents 1*b*,1*b* are formed bridging between the bulges. As a whole, the shape constructed of the bulges and dents are symmetrical with respect to the center axis of the shaft tube.

Figure 2:
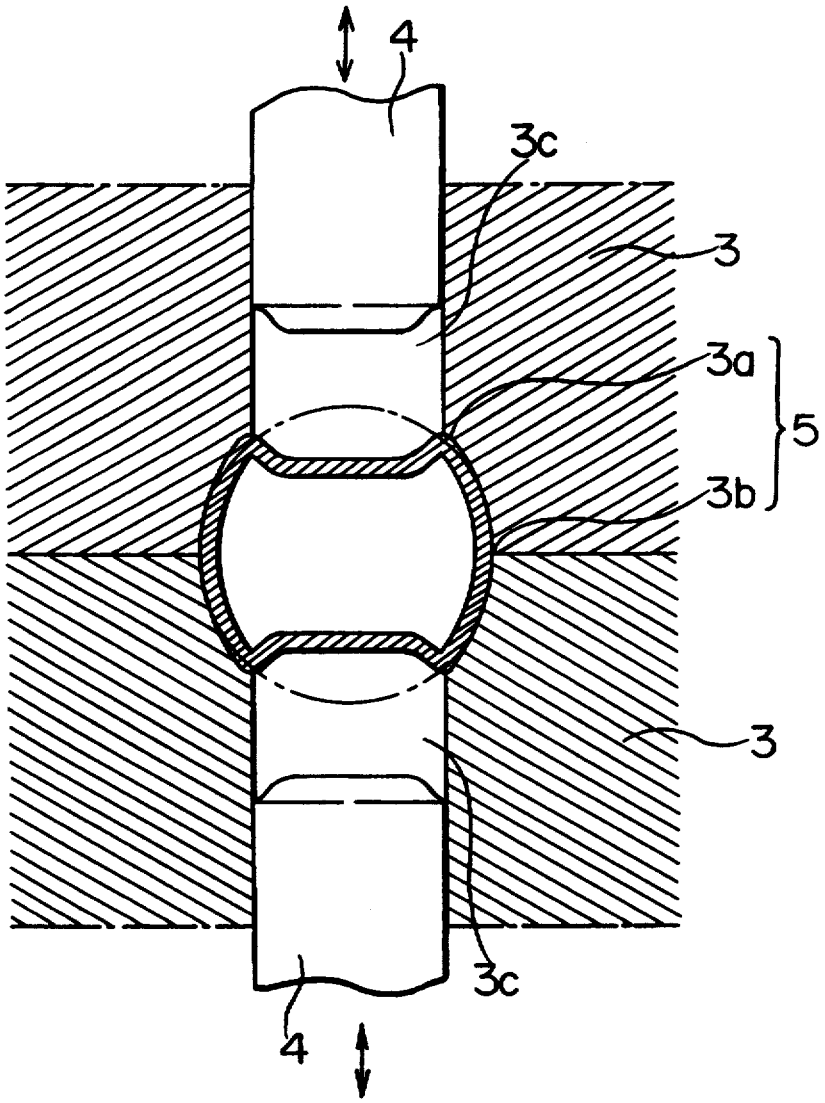
FIG. 2 illustrates a member in (B).

In a plan view, the shape is approximately square, and its corners are connected in a curved shape. Bulge and dent shapes may be formed at three or more locations, not restricted to the two as shown in FIG. 1 and FIG. 2.

The shaft tube must be most generally of a round pipe but may be of an oval, square or polygonal pipe as a hexagonal pipe in a sectional view. The bulge and dent shapes should be formed fitting to the tube shape. And a surface of the bulge la may be preferably grained or rugged to be rough for the purpose of increasing friction.

When the shaft tube 1 is furnished with the functional member 2, the bulge 1*a* is pressed by the bore or inner wall of the functional member 2 and the pressing force makes the dent 1*b* bent. The bending is in a predetermined extent calculated beforehand or within a non-yielding scope and keeps elasticity of the dent, which causes a kind of spring force. The spring force by the steel tube operates to make a strong pressing contact between the functional member and the shaft tube, which enables the shaft tube to firmly operate without idling away the functional member, when a rotating torque is exerted. When the bulges are formed symmetrically with respect to the center axis of the tube, restoring forces by the spring effects acting to the bulges 1*a* operate in a reverse direction each other and generate strong forces for the bulges to be pressed to the inner wall of the functional member. Consequently, pressing forces directed to four directions cause the shaft tube 1 to be fixedly secured to the functional member.

Now an embodiment of manufacturing method according to the present invention is described. First, a shaft tube is formed of a sheet steel and cut according to the purpose of use in a copying machine, word processor or the like.

On the other hand, as shown in FIG. Z, split half molds 3,3 are prepared, wherein swelled contours 3*a* are carved to accommodate the bulges 1*a*, holding contours 3*b* are formed to keep the tube at the basic diameter of the tube itself, and holes 3*c* are opened through the mold walls adjusted to the size of the dents. Punchs 4 are made to be inserted through the holes 3*c* and hit the shaft tube from outside. A tip of the punch is formed to fit to the dent 1*b*. A mold 5 is constructed of the half molds 3,3 and the punchs 4,4. When the dents 1*b* are located at the upper and lower, the punchs 4 should be arranged as a pair at the upper and lower so that the hitting may be performed simultaneously. The split half molds 3 with the holes 3*c* and the punchs 4 are arranged to locate the functional members at the predetermined places along the shaft tube. The number of the mold 5 or the punch 4 may be single or plural depending on the need.

The half molds 3 of the mold 5 can be separated at the split. After the shaft tube 1 is set at the predetermined location on the split and fixed at the both ends, the shaft tube is hit from one direction or simultaneously from the both directions upper and lower using the punchs 4 connected to a crank press or the like. The hitting pressure causes the tube to sink inward and form the dent 1*b* first, and the reaction extrudes the adjacent parts outward to form the bulges 1*a* mating the swelled contours 3*a* in one stroke.

A press-in tool 6 is prepared, which is provided with grooves 6*a* wherein such functional members 2 as a roller are placed according to the predetermined mounting locations. The shaft tube formed by the aforementioned method is pressed laterally in the mold 5. The press-in should preferably be performed as adjusting the pressing force and speed by a hydraulic means. Besides a hydraulic means, it may be carried out by a pressing means such as turning a screwed spindle. When the shaft tube is pressed in, the shaft tube goes in a hole 6*b* and the bulge of the shaft reaches the inner wall of a roller 2, functional member. When the shaft tube goes further, the tip of the bulge is suppressed by the inner wall and is forced inward. Then the dent 1*b* adjacent to the bulge 1*a* is bent, but when the bulges are formed symmetrically as shown in FIG. 1, the dent 1*b* receives stresses from both sides upper and lower to deflect elastically inward within a non-yielding scope. Consequently, the tip of bulge la sinks momentarily and can pass the first roller. The bulge passes each roller in the same manner along the shaft and finally sits on the predetermined location. This only series of press-in work can fixedly secure the functional members on the shaft tube tandem, to easily form the hollow shaft member.

Test 1

Resistant torques against turning were measured, under the following conditions where bulge diameter is d, axial length of the bulge is 4 mm, the dent is formed in a straight line, functional member is fixedly secured on the shaft tube and an outside force is exerted in a rotating direction.

functional member: paper feed roller formed of polyacetal plastic shaft tube: Stainless Steel JIS SUS 304 (equivalent to AISI 304) with outside diameter of 5.9 mm

TABLE 1

| | d | Resistant Torque (kgf · cm) |
|---|---|---|
| 1 | 6.568 | 8.0 |
| 2 | 6.479 | 8.0 |
| 3 | 6.470 | 8.0 |

Test 2

Resistant torques against turning were measured, under the following conditions where bulge diameter is d, axial length of the bulge is 4 mm, the dent is formed in a straight line, functional member is fixedly secured on the shaft tube and an outside force is exerted in a rotating direction.

functional member: paper feed roller formed of steel C3604BD boss shaft tube: Stainless Steel JIS SUS 304 (equivalent to AISI 304) with outside diameter of 5.97 mm

TABLE 2

| | d | Resistant Torque (kgf · cm) |
|---|---|---|
| 1 | 6.537 | 13.0 |
| 2 | 6.230 | 13.0 |

TABLE 2-continued

| | d | Resistant Torque (kgf · cm) |
|---|---|---|
| 3 | 6.223 | 12.0 |

In accordance with the test results, the shaft members with functional members of steel in Test 2 show relatively high resistant torques but ones in Test 1 also show satisfactorily high values for practical use.

By the way, the above mentioned embodiments are described typically as a shaft member for business machines, but the shaft members or the like of the same construction according to the present invention can be applied to fans or the like for such machines as air conditioners.

In accordance with the present invention, the functional members are fixedly secured firmly on the shaft without adhesive or being knurled, since the shaft tube of the present invention is provided with spring effect utilizing the hollow construction.

In accordance with the present invention of the manufacturing method, the shaft member can be easily and economically manufactured, since a manufacturing work is streamlined, comprising the shaft tube forming by hitting with mold and the assembly work by pressing-in with press-in tool.

Where the bulges and dents are located symmetrically with respect to the center axis of the tube, the shaft tube can be kept straight when manufactured and pressed in the functional member, as well as giving a firm securing forces.

The spring effect is constructional and the securing will not be deteriorated as time elapses. The spring effect can keep constant pressure on the inner wall of the functional member, which is different from adhesion or knurl.

Although a specific embodiment of the invention has been disclosed, it will be understood by those of skill in the art that the forgoing and other changes in form and details may be made therein without departing from the spirit and the scope of the invention.

What is claimed is:

1. A round shaft tube used in a business machine for engagement with a circular hole of a functional member, comprising:

a circular tubular member having an inner wall and an outer wall with the same diameter as the hole in the functional member;

said tubular member having deformed portions on which the functional member can be fixedly secured and undeformed portions;

said undeformed and deformed portions being arranged alternately along a longitudinal direction of said tubular member;

said deformed portions each comprising at least two dents and two bulges for each dent, said dents being equally spaced relative to each other along a circumference of said tubular member, said inner wall and said outer wall of said tubular member at the dents being depressed inwardly from a transverse round profile of an original shape of said tubular member, and said bulges being provided on both opposite edges of said dents, with each bulge comprising a swelling of said outer wall by a radial length of from 2% to 5% from its original diameter;

the wall section of said bulges and said dents having a spring effect within a non-yielding scope when a compression force is applied to the bulges;

whereby when said deformed section is positioned in said hole in the functional member, said bulge is depressed by a wall of said hole, thereby causing further inward depression of the wall of the tubular member at the dents which in turn causes a restoring force against the functional member, the cooperative and inward spring effect of said bulges and dents being used to fixedly secure the functional member to the shaft tube.

2. The round shaft tube in accordance with claim 1, wherein a profile of said dent is dish shaped.

3. A mender assembly for a business machine comprising:

a shaft tube as defined in claim 2; and a functional mender having a hole with the same diameter as the diameter of said undeformed portions of said tubular member, which is positioned on one of said deformed portion of said tubular member and secured thereto by compressing said bulges inwardly.

4. A member assembly in accordance with claim 3, wherein the functional member is a roller.

5. A member assembly for a business machine comprising:

a shaft tube as defined in claim 1; and a functional member having a hole with a diameter the same as the diameter of said undeformed portions of said tubular member, which is positioned on one of said deformed portions of said tubular member and secured thereto by compressing said bulges inwardly.

6. The member assembly in accordance with claim 5, wherein the functional member is a roller.

* * * * *